United States Patent [19]

Bullard

[11] Patent Number: 4,973,266

[45] Date of Patent: Nov. 27, 1990

[54] COMBINED TERMINAL SECONDARY LOCK AND SEAL

[75] Inventor: Peter H. Bullard, Harleysville, Pa.

[73] Assignee: Dill Products Incorporated, Norristown, Pa.

[21] Appl. No.: 230,476

[22] Filed: Aug. 9, 1988

[51] Int. Cl.[5] ..... H01R 13/40

[52] U.S. Cl. ..... 439/589; 439/281; 439/598

[58] Field of Search ..... 439/281, 581, 589, 592–596, 439/598

[56] References Cited

U.S. PATENT DOCUMENTS

| | | | |
|---|---|---|---|
| 3,693,134 | 9/1972 | Trevisiol | 339/59 M |
| 3,732,529 | 5/1973 | Weisenburger | 339/192 R |
| 3,745,515 | 7/1973 | Michaels | 339/156 R |
| 3,787,796 | 1/1974 | Barr | 339/94 R |
| 3,937,545 | 2/1976 | Cairns et al. | 339/60 R |
| 4,017,141 | 4/1977 | Bury et al. | 339/196 M |
| 4,029,382 | 6/1977 | Koda | 339/94 M |
| 4,173,349 | 11/1979 | Neale, III | 339/94 C |
| 4,214,802 | 7/1980 | Otani et al. | 339/94 M |
| 4,311,355 | 1/1982 | Plyler et al. | 399/94 R |
| 4,391,483 | 7/1983 | Desourteaux | 339/94 R |
| 4,614,390 | 9/1986 | Baker | 339/61 C |
| 4,684,187 | 8/1987 | Rudy, Jr. et al. | 439/598 |
| 4,711,508 | 12/1987 | Sueyoshi | 439/595 |
| 4,734,057 | 3/1988 | Noschese | 439/589 |
| 4,768,970 | 9/1988 | Nestor | 439/589 |
| 4,810,208 | 4/1989 | Hayes et al. | 439/589 |

*Primary Examiner*—P. Austin Bradley

*Attorney, Agent, or Firm*—William H. Elliott, Jr.; Richard D. Weber

[57] ABSTRACT

A combined terminal secondary lock and seal for securing a terminal within a connector cavity in sealed relation comprises a sleeve surrounding the end of the wire and a portion of the terminal and abutting against the widened terminal contact portion. The sleeve includes a plurality of apertures adjacent the insulated portion of the wire, which apertures define a plurality of axially aligned spaced slats sufficient to provide axial rigidity to the sleeve. A resilient seal ring is integrally molded into the apertures and extends outwardly into circumferential sealing engagement with a cavity of the connector and inwardly into circumferential sealing engagement with an insulated portion of the wire. A sleeve retainer is provided on the connector for securing the sleeve and terminal against axial movement.

17 Claims, 3 Drawing Sheets

COMBINED TERMINAL SECONDARY LOCK AND SEAL

BACKGROUND OF THE INVENTION

The present invention relates generally to electrical connectors and relates more particularly to a combined secondary lock and seal for securing and sealing conductor terminals within connector cavities.

A variety of types of electrical connectors and types of wire terminals for use with such connectors have been developed and are widely used, particularly in the automotive industry. While these connectors differ in detail, they typically involve a pair of molded plastic connectors having cavities within which the wire terminals are secured in place by means of a primary terminal lock. A common form of such lock is a tang extending from the terminal and engaging a shoulder portion of the cavity upon seating of the terminal within the cavity.

It has been recognized that such primary terminal locks are subject to malfunction or failure and the need for a secondary lock has resulted in the development of various types of secondary lock mechanisms, one of which is disclosed in my co-pending application, Ser. No. 58,982, filed June 8, 1987.

In many circumstances, it is necessary to provide a sealing of the connector terminal and this need can produce a significant complication in situations in which a secondary terminal lock is required. In one commercially available connector, a resilient seal is placed around the wire within the terminal cavity and a seal retainer is utilized to prevent the migration of the seal from the cavity. This does not, however, provide a satisfactory secondary terminal lock since upon failure of the primary terminal lock, the compressibility of the seal permits the withdrawal of the terminal from its seated position within the cavity, thereby interrupting its connection with the counterpart terminal in the cooperating connector.

SUMMARY OF THE INVENTION

The combined terminal secondary lock and seal of the present invention comprises a rigid substantially cylindrical sleeve disposed around the wire within the connector body cavity with the inner end of the sleeve engaged with the terminal. Apertures are provided in the sleeve adjacent the outer end thereof which define a plurality of parallel, axially aligned slats around which a resilient seal ring is integrally molded. The resilient seal ring around its outer circumference resiliently engages the connector cavity and around its inner circumference resiliently engages an insulated portion of the conductor to provide an effective seal between the conductor and the connector body. Means are provided on the connector body for engaging the outer end of the sleeve to prevent axial movement of the sleeve and terminal. The sleeve slats between the apertures, being axially aligned with the sleeve, provide sufficient sleeve rigidity to prevent axial compression under stress conditions.

It is accordingly a first object of the present invention to provide a combined terminal secondary lock and seal for an electrical connector which will effectively prevent the dislodging of the terminal from its seated position within the connector cavity while at the same time effectively sealing the connector cavity in the region of conductor entry.

A further object of the invention is to provide a secondary lock and seal as described which retains the terminal independently of the terminal primary lock.

Another object of the invention is to provide a secondary lock and seal as described which augments the terminal primary lock and thus increases the force required to dislodge the terminal from its seated position when the primary lock is functioning properly.

A still further object of the invention is to provide a secondary lock and seal as described which does not require rotational positioning during insertion into the connector and which serves to ensure a proper seating of the terminal in the connector.

Still another object of the invention is to provide a secondary lock and seal as described of a relatively simple, inexpensive construction which can be readily assembled and which requires relatively little space within the connector.

A still further object of the invention is to provide a secondary lock and seal as described which is readily adapted for multi-terminal connectors.

Additional objects and advantages of the invention will be more readily apparent when considered in connection with the following description of preferred embodiments thereof.

DESCRIPTION OF THE PREFERRED EMBODIMENTS

The secondary terminal lock and seal of the present invention can be adapted for use with a variety of types of terminals and connectors. An example of a connector assembly for receiving respective male and female conductor terminals and which incorporates the secondary lock and seal of the present invention is illustrated in FIGS. 6–11.

Figure 1:
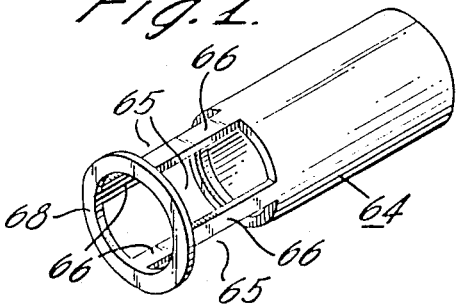
FIG. 1 is a perspective view of a secondary lock sleeve in accordance with the present invention prior to the molding of the elastic seal ring thereinto.
Figure 2:
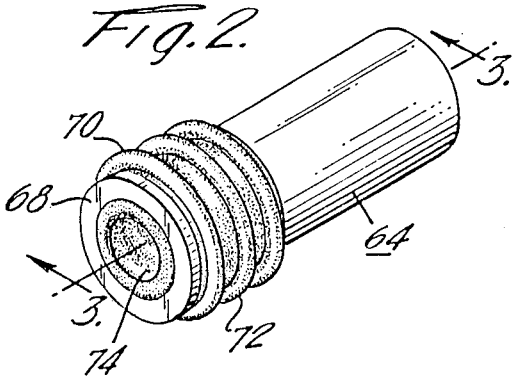
FIG. 2 is a view similar to FIG. 1 but with the addition of the molded elastic seal ring.
Figure 3:
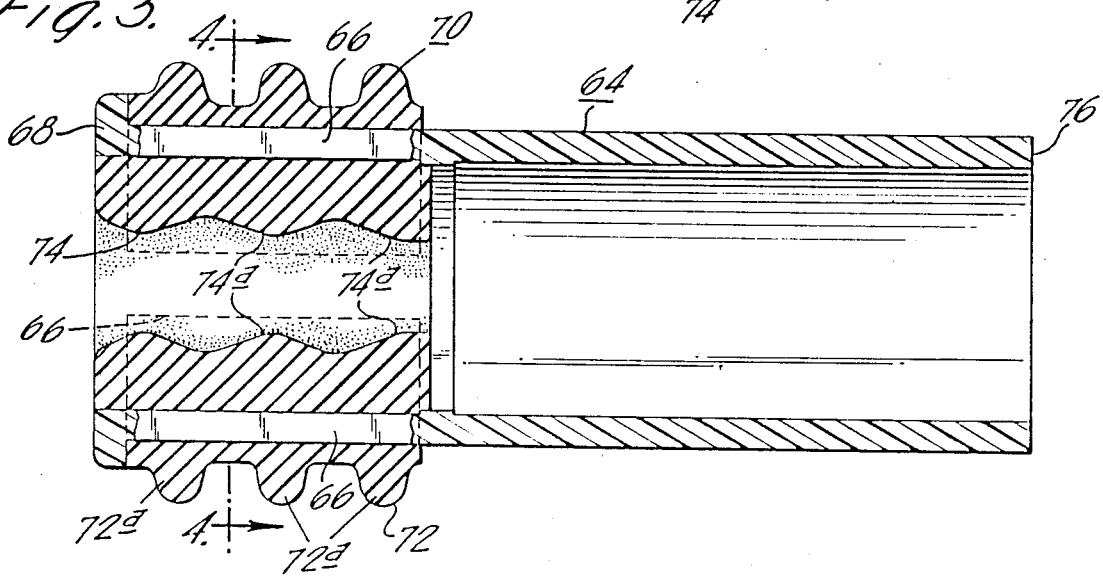
FIG. 3 is an enlarged sectional view taken along line 3—3 of FIG. 2.
Figure 4:
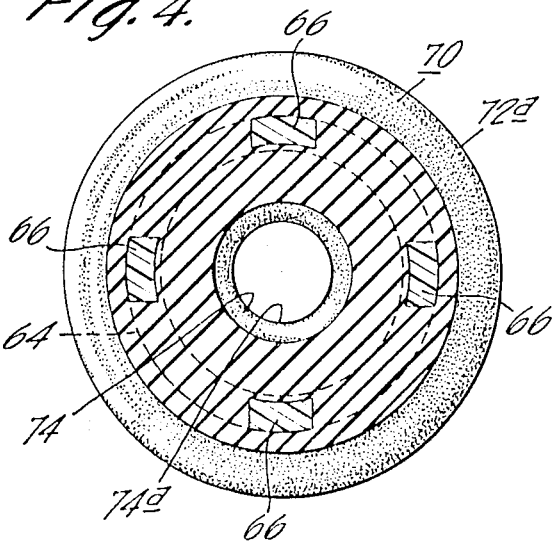
FIG. 4 is a sectional view taken along line 4—4 of FIG. 3.
Figure 5:
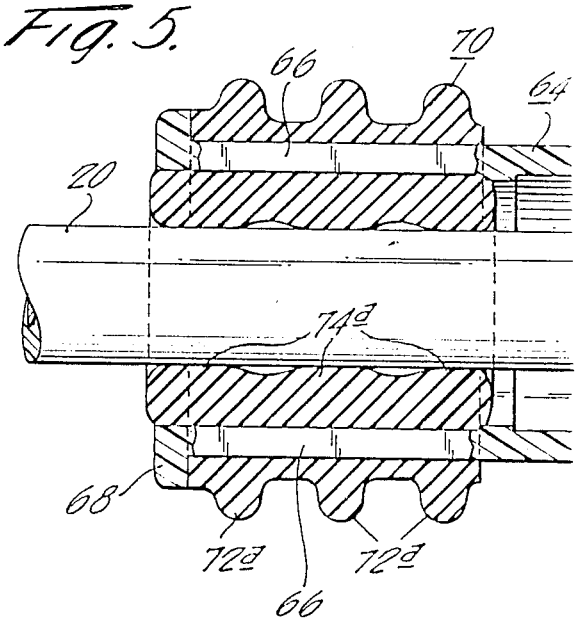
FIG. 5 is a partial view of the seal portion of the structure shown in FIG. 3 and additionally including an electrical conduit passing therethrough.
Figures 6, 7, 8, 9, 10, 11:
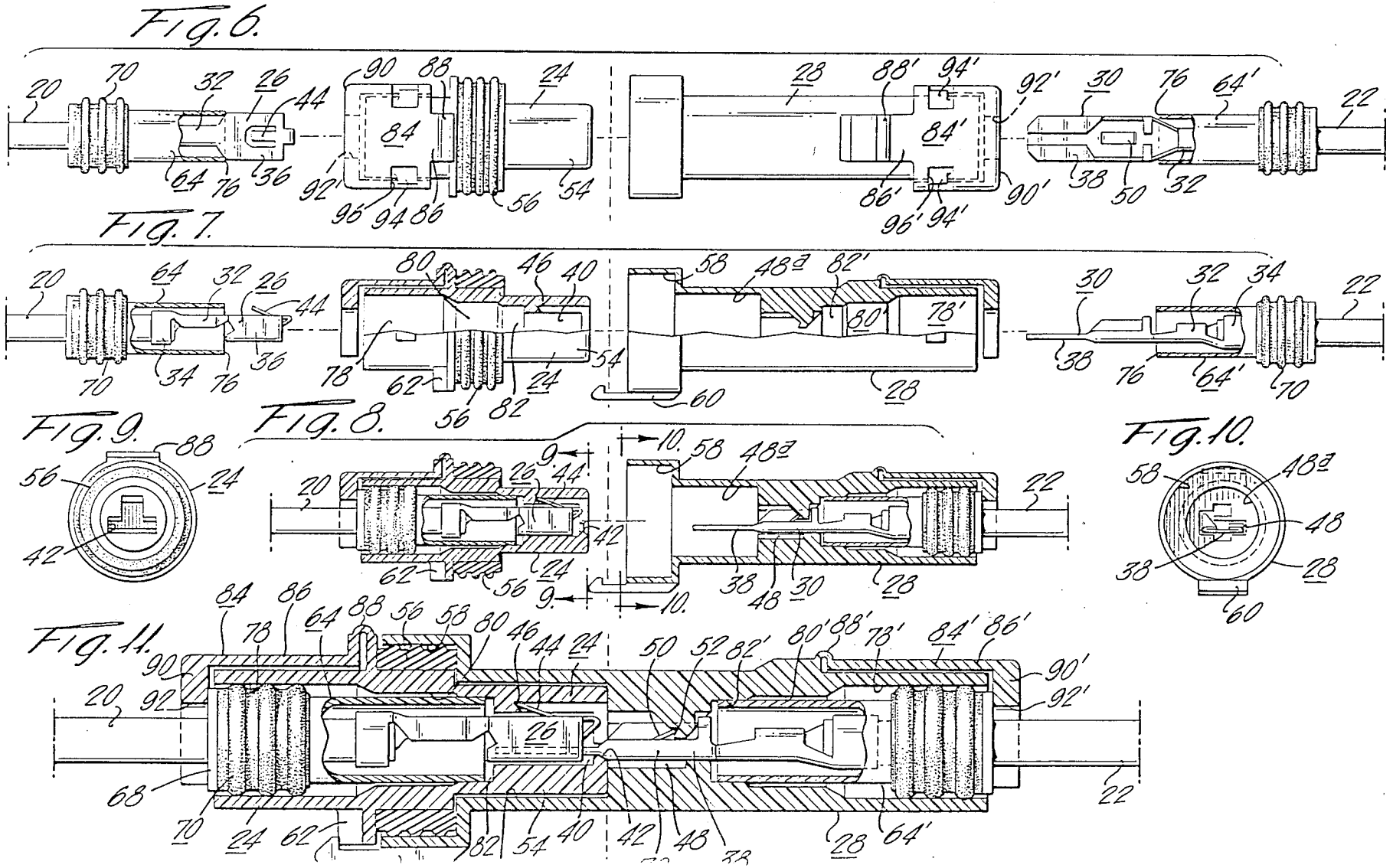
FIG. 6 is an exploded plan view of a connector employing the combined terminal secondary lock and seal of the invention.
FIG. 7 is an exploded side elevational view of the connector shown in FIG. 6.
FIG. 8 is a side elevational view of the connector of FIGS. 6 and 7 with the terminals seated in the connector bodies and with the combined terminal secondary locks and seals in place.
FIG. 9 is a view taken along line 9—9 of FIG. 8.
FIG. 10 is a view taken along line 10—10 of FIG. 8.
FIG. 11 is an enlarged elevational view of the connector of FIGS. 6–10 shown in the connected position.
Figure 12:
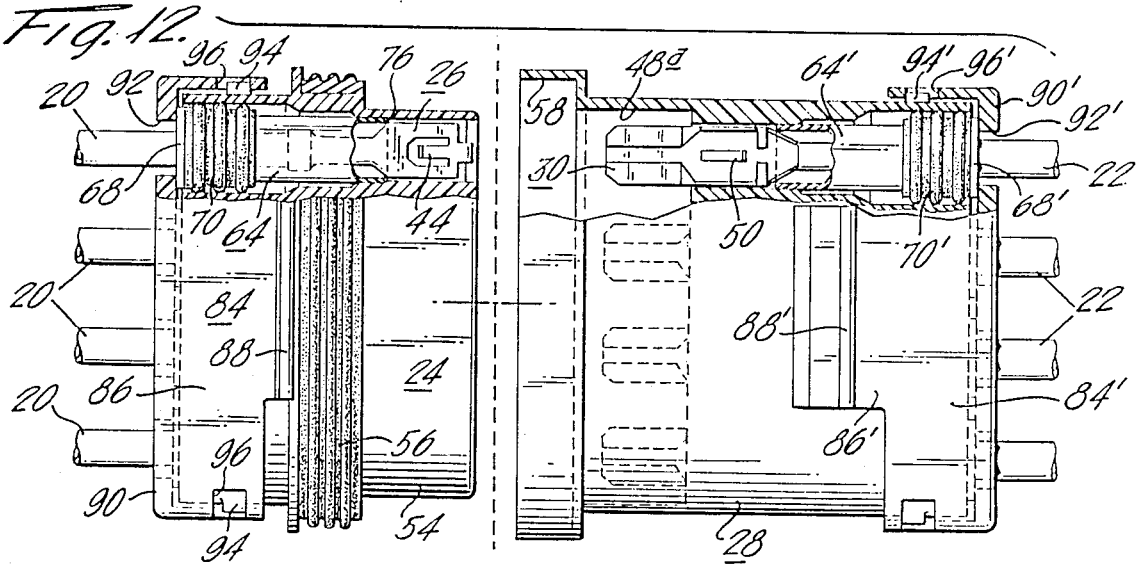
FIG. 12 is a plan view partly broken away and in section of a multiple conductor connector utilizing the combined terminal secondary lock and seal of the present invention and showing the connector in the separated position.
Figure 13:
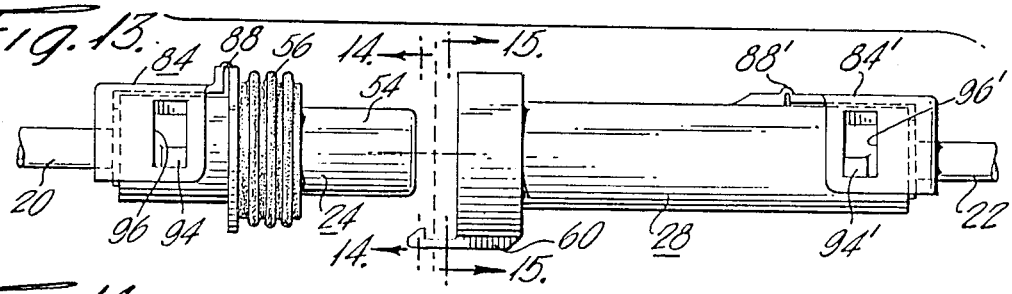
FIG. 13 is a side elevational view of the connector of FIG. 13.
Figure 14:
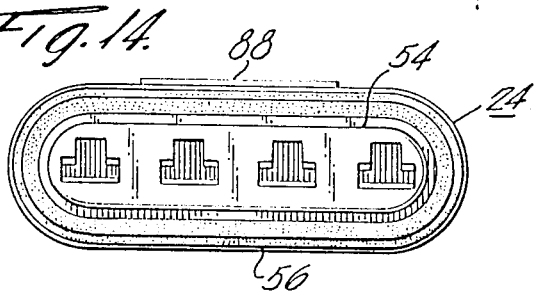
FIG. 14 is an enlarged view taken along line 14—14 of FIG. 13.
Figure 15:
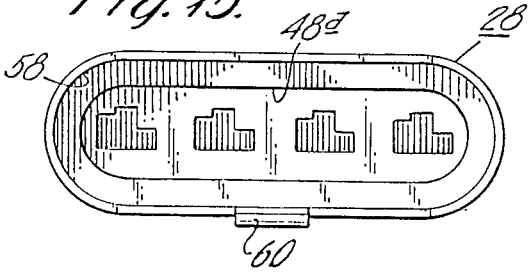
FIG. 15 is an enlarged view taken along line 15—15 of FIG. 13.
Figure 16:
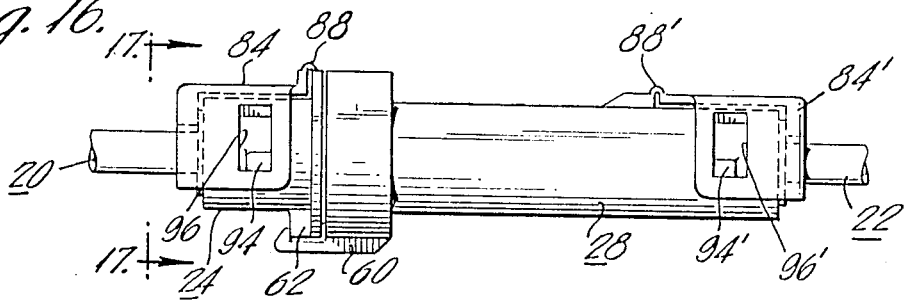
FIG. 16 is a side elevational view of the connector of FIGS. 13–15 in the connected position.
Figure 17:
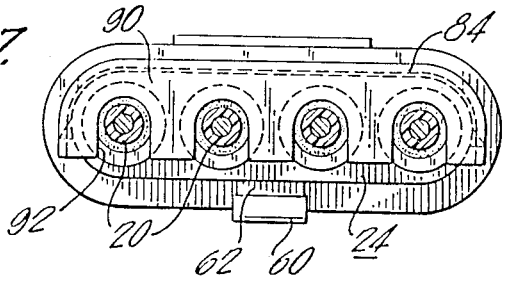
FIG. 17 is a view taken along line 17—17 of FIG. 6.

Considering the exploded views of FIGS. 6 and 7, a first electrical conductor in the form of an insulated wire 20 is adapted for connection to a similar electrical conductor in the form of an insulated wire 22 by means of a connector assembly which allows the selective connection or disconnection of the two wires. The connector assembly includes a first connector body 24 which is adapted to receive a female terminal 26 attached to the end of the wire 20 and a second connector body 28 adapted to receive a male terminal 30 attached to the end of the wire 22. The terminals 26 and 30 are respectively secured within cavities of the connector bodies 24 and 28 in a manner which will result in their guided interconnection upon the joining together of the connector bodies 24 and 28.

The terminals 26 and 30 are of a conventional type widely used in the automotive field. Specifically, the terminals are of a type made and sold by the Packard Electric Division of General Motors Corporation under the trademark METRI-PACK and require no modification for use with the present terminal secondary lock and seal. The terminals, which are formed from a single piece of sheet metal include core wings 32 which are crimped and soldered to the wire core, and insulating wings 34 which are crimped about the wire insulation.

The contact portions of the terminals respectively comprise a box-type female receptacle portion 36 of the terminal 26 and a blade type contact 38 of the terminal 30 which is adapted to be received in snug-fitting frictional engagement within the receptacle portion 36 of the terminal 26. The contact portions of the terminals are substantially wider than the wing portions 32 and 34 thereof as may be seen in the plan view of FIG. 6.

The connectors 24 and 28, which are preferably made of a molded plastic insulating material such as nylon, are each characterized by stepped cavities for receiving and securing the terminals in a predetermined seated position therewithin such that the joining of the connectors will produce the proper alignment and interconnection of the terminal contact portions 36 and 38. Considering first the connector 24 which receives the female terminal 26, this connector at one end includes a cavity 40 shaped to receive the contact portion 36 of the terminal in only one orientation such that the terminal is properly aligned with a slot 42 in the connector end through which the blade contact portion 38 of terminal 30 is ultimately introduced. A locking tang 44 of the terminal 26 springs into engagement with a shoulder 46 of the cavity 40 in the seated position of the terminal and constitutes a primary terminal lock to prevent withdrawal of the terminal once it is properly seated in the cavity 40.

Similarly, the connector 28 includes a cavity 48 which receives the blade-like contact portion 38 of terminal 30 in a predetermined orientation. A locking tang 50 of the terminal 38 engages a shoulder 52 of the cavity 48 and serves as a primary terminal lock. The cavity 48 includes an enlarged portion **48*a* surrounding the blade portion 38 and into which the outer end 54 of the terminal 24 is disposed in the joined position of the connectors shown in FIG. 11, thereby permitting the blade portion 38 to enter the female portion 36**.

In order to provide a sealed connection of the joined connectors 24 and 28, a resilient seal ring 56 is mounted on the connector 24 inwardly of the end portion 54 and cooperates with an outer cavity 58 of the connector 28 to seal the joined connectors. A locking arm 60 extending axially outwardly from the connector 28 is adapted to engage a boss 62 on the connector 24 to lock the connectors together. The resilience of the locking arm 60 permits it to be resiliently released from engagement with the boss to permit selective disconnection of the connectors.

The connectors and terminals as thus far described are essentially conventional. Although the terminals are held within their respective connector cavities by the tangs constituting the primary terminal locks, these tangs are rather small and fragile, and are often subject to dislodgement or failure due to axial loads placed on the wires or after a period of exposure to vibrations, such as in an engine compartment. Furthermore, the connector assembly as described does not provide a sealing of the terminal cavities along the wires. The present invention, as will now be described, provides a combination secondary lock and a seal of the connector cavities at the points of wire entrance.

The invention includes a locking and sealing sleeve 64 which is shown in detail in FIGS. 1–5. The sleeve 64, which is preferably molded of a plastic material, such as nylon, is of a substantially cylindrical tubular configuration. The sleeve includes a plurality of apertures 65 adjacent one end as most clearly seen in FIG. 1. These apertures define a plurality of spaced parallel axially aligned slats 66 which are of sufficient size to maintain the integrity of the sleeve outer end 68.

A seal ring 70 of resilient material such as silicone rubber is molded within the apertures 65 and around the slats 66 and accordingly comprises an integral seal ring having an outer circumferential sealing surface 72 extending radially outboard of the sleeve 64 and an inner circumferential surface 74 extending inwardly of the sleeve interior wall. The surface 72 is preferably formed to define a plurality of axially spaced ridges **72*a* extending outwardly to provide a series of sealing surfaces. Similarly, the inner surface 74 is preferably characterized by axially spaced hills and valleys to provide a series of inwardly extending sealing regions 74*a*. The sleeve end 68** extends radially beyond the cylindrical surface of the sleeve, thereby providing an annular flange against which the seal ring is molded.

As shown in FIGS. 6–11, a sleeve 64 is disposed around each of the wires 20 and 22 with the ends 76 of the sleeves engaging respectively the terminals 26 and 30. The sleeve is appropriately sized such that the inner sleeve diameter passes freely over the insulating wings and core wings of the terminals, and the sleeve ends 76 accordingly abut against the widened terminal outer end portions. The seal rings 70 of the sleeves and specifically the inner surface portions **74*a*** thereof resiliently engage the insulated wire inwardly of the insulating wings.

To accommodate the sleeves 64, the connectors 24 and 28 each include stepped cavities substantially concentric with and communicating with the connector cavities 40 and 48. With reference to connector 24, the cavity for receiving the sleeve 64 comprises as most readily seen in FIG. 7, a large cylindrical cavity portion 78 at the wire entrance end of the connector, a smaller cylindrical cavity portion 80 aligned with and opening from the cavity 78, and an even smaller cavity portion 82 opening into the connector cavity 40. The cavity 82 is only slightly larger in diameter than the external diameter of the sleeve 64 to permit sliding movement of the sleeve into this portion of the connector cavity. As illustrated, the transitions between the cavity portions are tapered to permit the ready introduction of the sleeve into the connector.

As shown in FIG. 11, when the terminal 26 is seated in the connector 24, the introduction of the sleeve 64 into abutment with the terminal results in a cooperative sealing engagement of the sleeve seal ring 70 and more particularly the ridges 72*a* thereof with the connector cavity 78, resulting in a sealing deformation of the resilient seal ring. When the sleeve is fully inserted into the connector cavity and abutting the terminal as shown in FIG. 11, the end 68 of the sleeve extends outwardly from the cavity 78 slightly beyond the end of the connector. Means are provided on the connector for securing the sleeve against axial movement, thereby preventing movement of the terminal. In the illustrated embodiment, this means comprises a sleeve retainer 84 which comprises an arm 86 integrally molded with the connector and having a self-hinge 88 extending transversely across the connector. The arm 86 includes an angled portion 90 which engages the sleeve to prevent axial movement thereof. A slot 92 in the portion 90 provides clearance for the wire 20. The sleeve retainer need not be an integrally molded element, and could, for example, comprise a separate element which is snapped in place over the connector.

The connector 28 is configured in a manner virtually identical to the connector 24 to accommodate a sleeve 64′ disposed around the wire 22 and engaging the terminal 30. As shown in FIGS. 7, 8 and 11, the connector 28 includes stepped cavity portions 78′, 80′ and 82′ corresponding to the equivalent cavity portions 78, 80 and 82 of the connector 24 and serving the same functions with respect to the sleeve 64′. The connector 28 includes a retaining means 84′ comprising arm 86′ hinged at 88′ to the connector body. The angled portion 90, of the arm includes a slot 92′ to accommodate the wire 22. As with the retainer 84 of the connector 24, the retainer 84, of connector 28 engages and prevents the axial movement of the sleeve 64′ and thereby secures the terminal 30 in its seated position within the connector cavity 48.

The sleeve 64 may be placed on the wire end prior to attachment of the terminals, or may be introduced from the opposite ends of the wires after the terminals have already been attached. With the terminals attached and the sleeves in position as shown in FIG. 6, the securing of the terminals within the connectors is a simple operation requiring simply the lifting of the retainers 84 and 84′ and the insertion of the terminals into their seated positions within the terminal cavities of the connectors, resulting in the automatic extension and locking of the tangs 44 and 50 constituting the primary terminal locks. With the sleeves 64 and 64′ firmly seated against the inner ends of the expanded terminal portions, the sleeve retainers 84 and 84′ are swung downwardly to prevent axial movement of the sleeves or the terminals engaged therewith.

In order to prevent the sleeve retainers 84 and 84′ from swinging out of engagement with the sleeves, ears 94 are provided externally on the sides of the connector 24, which ears extend through apertures 96 in the retainer arm 86 to lock the retainer in position. A small degree of deformation of the retainer arm is required to permit the ears to snap into position in the apertures. Release of the locking arrangement is effected by pushing upwardly on the arm 86 adjacent the ears to free the ears from engagement with the apertures.

An identical arrangement is provided with respect to the sleeve retainer 84′ of the connector 28. Ears 94′ cooperatively located with respect to apertures 96′ of the retainer arm 86′ provide the desired locking function.

The embodiment of FIGS. 12–17 differs from the embodiment described above only in the showning of connectors 24′ and 28′ which are provided with a plurality of terminal receiving cavities, specifically four cavities, to permit the simultaneous connection or disconnection of four electrical conductors. The structure of the individual terminal cavities and the usage of the secondary lock and seal sleeves are identical with those of the embodiment described above. Accordingly, a detailed description of the structure of this embodiment is not deemed necessary. The sleeve retainers 84 and 84′ of this embodiment each include a plurality of slots 92 and 92′ to accommodate the plurality of wires entering the connectors.

Although the embodiment of FIGS. 12–17 shows a plurality of terminals disposed in a spaced linear arrangement, it should be obvious that any desired terminal arrangement could be utilized with the present secondary lock and seal as long as each terminal cavity is adapted to receive the sleeve and suitable sleeve retaining means are provided on the connectors.

There are a number of advantages of the present secondary lock and seal. It requires relatively little space in the connector and is very simple to install since it does not require any special rotational positioning with respect to the terminal or the connector cavity. If the sleeve goes into the connector cavity a sufficient distance to permit the latching of the sleeve retainer arm, there is assurance that the terminal is fully seated and that the primary terminal lock is in position for deployment. The present secondary lock and seal retains the terminal in the seated position independently of the terminal primary lock should the primary lock fail. However, the primary and secondary lock augment each other's locking force in the sense that in order to dislodge the terminal from its seated position, the force must be sufficiently great to cause failure of both the primary and secondary locks simultaneously.

The construction of the sleeve whereby the resilient seal ring extends through the apertures of the sleeve provides an extra degree of resilience which facilitates the entrance of the wire within the seal ring as well as facilitating the entrance of the sleeve into the connector cavity. This results from the maximization of the amount of resilient material between the connector cavity and the wire while retaining sufficient strength in the slats 66 to transmit axial terminal retention forces through the seal ring to the sleeve retainer portion of the connector body.

Manifestly, changes in details of construction can be effected by those skilled in the art without departing from the invention.

I claim:

1. An electrical connector assembly including an insulated wire, a terminal attached to an end of said wire, a connector having a cavity therein adapted to receive said terminal and an adjacent insulated portion of said wire in a seated position therewithin, said cavity including a substantially cylindrically shaped portion, a primary lock mechanism comprising a resilient latch for preventing withdrawal of said terminal and wire from said seated position, and a combination secondary lock and seal comprising a tubular, substantially cylindrical sleeve disposed concentrically around said wire within said connector cavity with the inner end of said sleeve engaged with said terminal, a sleeve retainer on said connector body outside of said cavity for engaging the outer end of said sleeve to prevent substantial axial movement of said sleeve and terminal, apertures in said sleeve between the ends thereof defining a plurality of parallel, axially aligned, circumferentially spaced slats therebetween, and a resilient seal ring integrally molded into said sleeve apertures, said seal ring being axially coextensive with said apertures, said seal ring having an outer circumferential sealing surface extending radially outwardly beyond the outer surface of said sleeve for resilient engagement with the cylindrical portion of said connector cavity, and an inner circumferential sealing surface extending radially inwardly of the inner surface of the sleeve for resilient engagement with said insulated portion of said wire to provide a seal between said wire and said connector cavity, said slats being radially deformable to permit said seal ring to accommodate insulated wires of different diameters, said slats and the sleeve portions at each end thereof serving to transmit axial withdrawal forces imposed on said terminal by said wire to said sleeve retainer whereby said secondary lock serves with said primary lock to prevent withdrawal of said terminal from said seated position within said cavity.

2. The connector assembly as claimed in claim 1, wherein said sleeve apertures are disposed adjacent the outer end of said sleeve.

3. The connector assembly as claimed in claim 1, wherein said sleeve apertures comprise more than 50% of the sleeve surface area around which said seal ring is disposed.

4. The connector assembly as claimed in claim 1, wherein said seal ring is comprised of silicone rubber.

5. The connector assembly as claimed in claim 1, wherein said seal ring inner and outer circumferential surfaces are characterized by axially spaced ridges, each said ridge defining a discrete sealing region of said seal ring.

6. The connector assembly as claimed in claim 1, wherein said connector comprises a plurality of said cavities, a plurality of said wires with attached terminals disposed in said cavities, and a plurality of said secondary locks and seals, each wire and terminal having a secondary lock and seal cooperatively associated therewith.

7. The connector assembly as claimed in claim 1, wherein said sleeve is formed of a molded plastic material.

8. The connector assembly as claimed in claim 7, wherein said molded plastic material comprises nylon.

9. The connector assembly as claimed in claim 1, wherein the inner end of said cavity is smaller than the outer end to guide said sleeve into alignment with said terminal.

10. The connector assembly as claimed in claim 9, wherein said inner cavity end comprises a cylindrical surface in close fitting relation with said sleeve inner end to support said sleeve inner end and prevent deformation thereof by said terminal.

11. A secondary lock and seal for use with an electrical connector to lock and seal an insulated wire having a terminal on the end thereof in a seated position within a cavity of the connector, said secondary lock and seal comprising a tubular, substantially cylindrical sleeve adapted for disposition around said wire within said connector cavity with the inner end of the sleeve engaging the terminal and the outer end engaging a sleeve retainer on the connector outside of the cavity, said sleeve comprising apertures between the ends thereof defining a plurality of parallel, axially aligned, circumferentially spaced slats therebetween, and a resilient seal ring integrally molded into said sleeve apertures, said seal ring being axially coextensive with said apertures, said seal ring having an outer circumferential sealing surface extending radially outwardly beyond the outer surface of said sleeve for resilient engagement with the connector cavity, and an inner circumferential sealing surface extending radially inwardly of the inner surface of the sleeve for resilient engagement with the insulated portion of the wire to provide a seal between the wire and cylindrical portion of the connector cavity, said slats being radially deformable to permit said seal ring to accommodate insulated wires of different diameters, said slats and the sleeve portions at each end thereof serving to transmit axial withdrawal forces imposed on said terminal by said wire to said sleeve retainer whereby said secondary lock serves to prevent withdrawal of said terminal from said seated position within said cavity.

12. The secondary lock and seal as claimed in claim 11, wherein said sleeve apertures are disposed adjacent the other end of said sleeve.

13. The secondary lock and seal as claimed in claim 11, wherein said sleeve apertures comprise more than 50% of the sleeve surface area around which said seal ring is disposed.

14. The secondary lock and seal as claimed in claim 11, wherein said seal ring is comprised of silicone rubber.

15. The secondary lock and seal as claimed in claim 11, wherein said seal ring inner and outer circumferential surfaces are characterized by axially spaced ridges, each said ridge defining a discrete sealing region of said seal ring.

16. The secondary lock and seal as claimed in claim 11, wherein said sleeve is formed of a molded plastic material.

17. The secondary lock and seal as claimed in claim 16, wherein said molded plastic material comprises nylon.

* * * * *